US007290994B2

(12) United States Patent
Kitaichi et al.

(10) Patent No.: US 7,290,994 B2
(45) Date of Patent: Nov. 6, 2007

(54) ROTARY HERMETIC COMPRESSOR AND REFRIGERATION CYCLE SYSTEM

(75) Inventors: Shoichiro Kitaichi, Fuji (JP); Norihisa Watanabe, Fuji (JP); Takeshi Tominaga, Fuji (JP); Kazu Takashima, Fuji (JP); Isao Kawabe, Fuji (JP); Masayuki Suzuki, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 90 days.

(21) Appl. No.: 11/302,393

(22) Filed: Dec. 14, 2005

(65) Prior Publication Data

US 2006/0093494 A1 May 4, 2006

Related U.S. Application Data

(63) Continuation of application No. PCT/JP2004/008701, filed on Jun. 15, 2004.

(30) Foreign Application Priority Data

Jun. 20, 2003 (JP) ..... 2003-177155

(51) Int. Cl.
*F03C 2/00* (2006.01)
*F04C 2/00* (2006.01)

(52) U.S. Cl. ..... 418/60; 418/11; 418/63; 418/212; 418/270

(58) Field of Classification Search ..... 418/11, 418/60, 63, 249, 212, 270; 417/212, 216, 417/286, 298, 410.3, 441; 62/196.2, 510
See application file for complete search history.

(56) References Cited

U.S. PATENT DOCUMENTS 4,780,067 A * 10/1988 Suzuki et al. ..... 418/60
5,013,217 A * 5/1991 Hitosugi ..... 417/26
5,242,280 A * 9/1993 Fujio ..... 418/60
6,769,267 B2 * 8/2004 Ebara et al. ..... 62/296

(Continued)

FOREIGN PATENT DOCUMENTS

JP 56012085 A * 2/1981 ..... 417/429

(Continued)

OTHER PUBLICATIONS

International Search Report dated Nov. 2, 2004 for Appln. No. PCT/JP2004/008701.

*Primary Examiner*—Theresa Trieu
(74) *Attorney, Agent, or Firm*—Pillsbury Winthrop Shaw Pittman, LLP

(57) ABSTRACT

A vane of a first cylinder is compressed and urged by a spring member. A vane of a second cylinder is compressed and urged corresponding to a differential pressure between an intra-casing pressure guided into a vane chamber and a suction pressure or discharge pressure guided to the cylinder chamber. A pressure shift mechanism which guides the suction pressure or discharge pressure has a branch pipe having a one end connected to a high pressure side of the refrigeration cycle, an other end connected to a suction pipe, and a first on-off valve in a midway portion, and a second on-off valve or a check valve which is provided in the suction pipe on a side upstream of a connection portion of the branch pipe and on a side downstream of an oil returning opening in an accumulator.

10 Claims, 7 Drawing Sheets

U.S. PATENT DOCUMENTS

| | | | | |
|---|---|---|---|---|
| 6,796,773 | B1 * | 9/2004 | Choi et al. | 418/60 |
| 2006/0002809 | A1 | 1/2006 | Kawabe et al. | |

FOREIGN PATENT DOCUMENTS

| | | |
|---|---|---|
| JP | 60-63093 | 5/1985 |
| JP | 01-247786 | 10/1989 |
| JP | 04-020751 | 1/1992 |
| JP | 04-241791 | 8/1992 |
| JP | 2803456 | 7/1998 |

* cited by examiner

ROTARY HERMETIC COMPRESSOR AND REFRIGERATION CYCLE SYSTEM

CROSS REFERENCE TO RELATED APPLICATIONS

This is a Continuation Application of PCT Application No. PCT/JP2004/008701, filed Jun. 15, 2004, which was published under PCT Article 21(2) in Japanese.

This application is based upon and claims the benefit of priority from prior Japanese Patent Application No. 2003-177155, filed Jun. 20, 2003, the entire contents of which are incorporated herein by reference.

BACKGROUND OF THE INVENTION

1. Field of the Invention

The present invention relates to a rotary hermetic compressor that configures a refrigeration cycle of, for example, an air conditioner, and to a refrigeration cycle system configuring a refrigeration cycle by using the rotary hermetic compressor.

2. Description of the Related Art

Generally or commonly used rotary hermetic compressors have a configuration of an intra-casing high pressure type that accommodates in a hermetic casing an electric motor section and a compression mechanism section coupled with an electric motor section, in which a gas compressed in the compression mechanism section is once discharged into the hermetic casing.

In the compression mechanism section, an eccentric roller is accommodated in a cylinder chamber provided in a cylinder, a vane chamber is provided in the cylinder, and the vane is accommodated therein. A front end edge is compressed and urged by a compression spring to normally extend to the side of the cylinder chamber so as to elastically contact a peripheral surface of the eccentric roller. The cylinder chamber is separated by the vane into two chambers along the rotation direction of the eccentric roller, in which a suction section is communicated to one of the chambers, and a discharge section is communicated to the other chamber. A suction pipe is connected to the suction section, and the discharge section is opened in the hermetic casing.

In recent years, two-cylinder rotary hermetic compressors having two cylinders of the type described above are being standardized. In a compressor of the type, if a cylinder for normally performing compression operation and a cylinder enabling compression-stopping switching can be provided, the specification is enhanced, and the compressor is thereby made advantageous.

For example, Jpn. Pat. Appln. KOKAI Publication No. 1-247786 (hereinafter, referred to as "Patent Document 1") discloses a technique characterized by including two cylinder chambers and high-pressure introducing means that forcibly causes a vane of either one of the cylinder chambers to be away from a roller and that causes the cylinder chamber to be a highly pressurized to stop the compression operation.

In addition, Japanese Patent No. 2803456 ("Patent Document 2", hereafter) discloses a technique in which a bypass pathway is provided as high-pressure introducing means for introducing high pressure from a hermetic container into a suction pipe. In one cylinder chamber, a vane is brought by operation of an elastic material into contact with a roller even during operation with an inoperative cylinder, and a compression chamber is normally separated by the vane.

A compressor disclosed in Patent Document 1 is functionally excellent. However, for configuring the high-pressure introducing means, a high-pressure introducing opening for communication between one of the cylinders and the hermetic casing is provided; a double-throttling mechanism is provided in a refrigeration cycle; and a bypass refrigerant pipe including a solenoid on-off valve is provided, the bypass refrigerant pipe being branched from a middle portion of the throttling mechanism for communication to one of vane chambers.

More specifically, for example, opening-forming processing is necessary, a throttle device on the refrigeration cycle has to be configured into the double-throttling mechanism, and further, the bypass refrigerant pipe has to be connected between the double-throttling mechanism and the cylinder chamber, so that the configuration is complicated to the extent of providing adverse effects.

In the previous technique disclosed in Patent Document 2, a connection step for the bypass pipe that bypasses a discharge side and a suction side to the hermetic container is necessary, thereby providing adverse effects in cost. In addition, the vane is normally brought into elastic contact with the roller even during the operation with an inoperative cylinder, such that the efficiency is reduced because of the presence of, for example, a slight amount of compression operation and a sliding loss.

The present invention is made under these circumstances, and an object thereof is to provide a rotary hermetic compressor in which, in a prerequisite condition in which first and second cylinders are provided, a compression urging structure for a vane of one of the cylinders is omitted to attain improvement in lubricity and reliability, and the number of components and the processing time and costs are reduced to thereby contribute to cost reduction; and a refrigeration cycle system using the rotary hermetic compressor.

BRIEF SUMMARY OF THE INVENTION

For satisfy above object, the present invention provides a rotary hermetic compressor for use in a refrigeration cycle, in which an electric motor section and a rotary compression mechanism section to be coupled to the electric motor section are accommodated, a refrigerant evaporated in a vaporizer is drawn into the compression mechanism section through an accumulator, and a refrigerant gas compressed therein is once discharged into a hermetic casing, thereby to create an intra-casing high pressure, wherein the compression mechanism section comprises: a first cylinder and a second cylinder which each includes a cylinder chamber wherein an eccentric roller is eccentrically rotatably accommodated; and vanes which are respectively provided in the first cylinder and the second cylinder wherein front end portions thereof are each compressed and urged to contact a peripheral surface of the eccentric roller to thereby bisectionally separate the cylinder chamber along a rotation direction of the eccentric roller, and vane chambers which accommodate rear side end portions of the respective vanes, the vane provided in the first cylinder is compressed and urged by a spring member disposed in the vane chamber, the vane provided in the second cylinder is compressed and urged corresponding to a differential pressure between an intra-casing pressure guided into the vane chamber and a suction pressure or discharge pressure guided to the cylinder chamber, and means for guiding the suction pressure or discharge pressure into the cylinder chamber of the second cylinder comprises: a branch pipe having a one end connected to a high pressure side of the refrigeration cycle, an other end connected to a suction pipe communicating from the accumulator to the cylinder chamber of the second cylinder, and a first on-off valve in a midway portion; and a second on-off valve or a check valve which is provided in the suction pipe on a side upstream of a connection portion with the branch pipe and on a side downstream of an oil returning opening opened to a suction pipe section in the accumulator.

For satisfy above object, a refrigeration cycle system of the present invention, wherein a refrigeration cycle is configured of above rotary hermetic compressor, a condenser, an expander mechanism, and a vaporizer.

With the means employed to solve the above-described problems, a compression urging structure for a vane of one of the cylinders is omitted to thereby making it possible to attain improvement in lubricity and reliability, and the number of components the processing time and costs are reduced to thereby contribute to cost reduction.

DETAILED DESCRIPTION OF THE INVENTION

Embodiments of the present invention will be described herebelow in accordance with the drawings.

Figure 1:
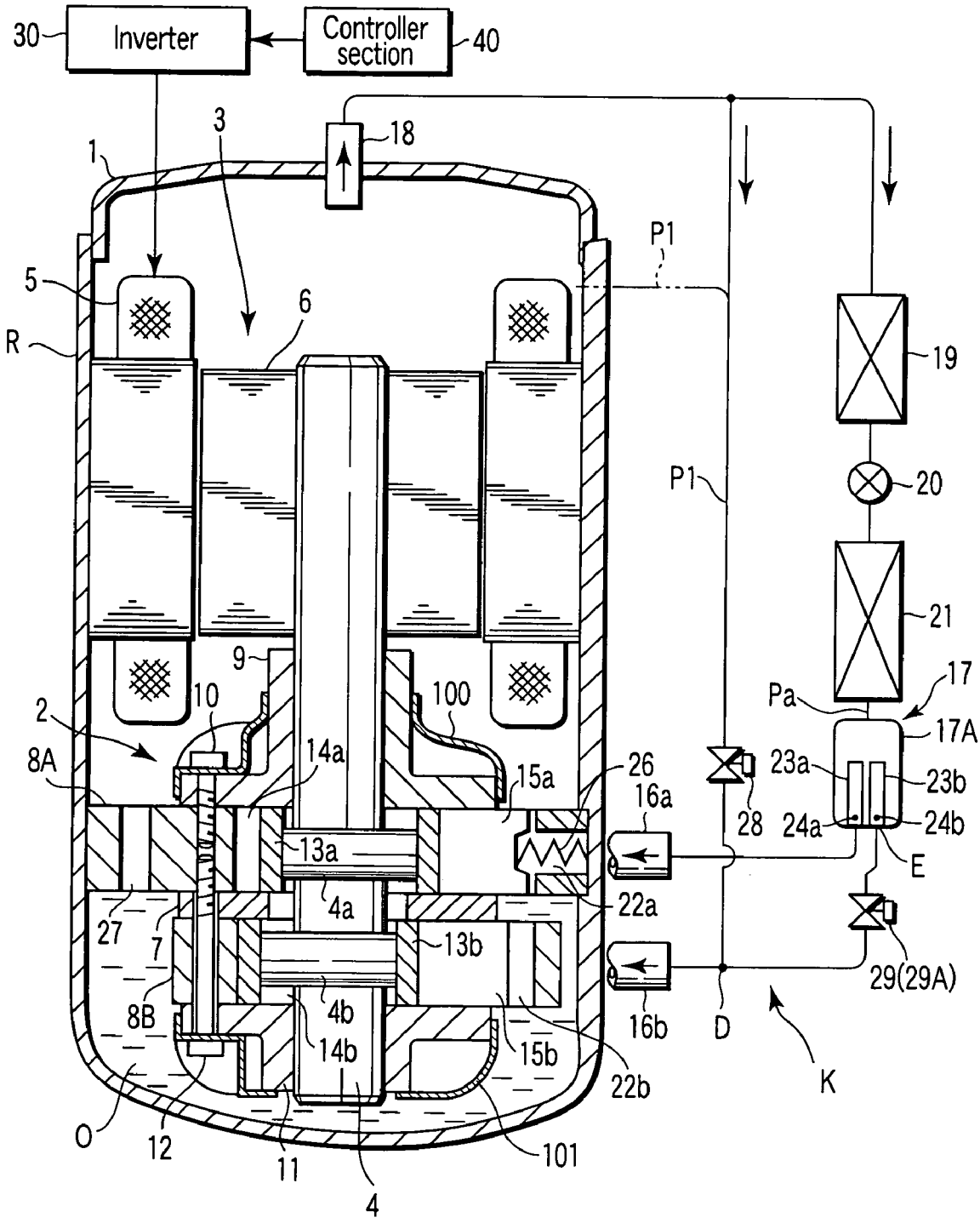
FIG. 1 shows an elevational cross-sectional view of a rotary hermetic compressor and a configuration view of a refrigeration cycle in accordance with a first embodiment of the present invention.

FIG. 1 shows an elevational cross-sectional view of a rotary hermetic compressor R and a refrigeration cycle configuration view of a refrigeration cycle including the rotary hermetic compressor R in accordance with a first embodiment of the present invention.

First, the rotary hermetic compressor R will be described. Numeral 1 denotes a hermetic casing 1. A compression mechanism section 2, which will be described below, is provided in a lower portion of the hermetic casing 1, and an electric motor section 3 is provided in an upper portion thereof. The electric motor section 3 and the compression mechanism section 2 are intercoupled via a rotation shaft 4. A sump portion O for a lubricant oil is formed in the bottom portion of the hermetic casing 1. As the lubricant oil, polyol ester oil is used (however, mineral oil, alkyl benzene, PAG, or fluoric oil may be used depending on the type of refrigerant).

The electric motor section 3 uses a brushless DC synchronous motor (which alternatively may be an AC motor or a commercial motor) configured of a stator 5 and a rotor 6. The stator 5 is fixedly secured to an internal surface of the hermetic casing 1, and rotor 6 is disposed inside the stator 5 with a predetermined spacing inside the stator 5 and receives the rotation shaft 4 inserted. The electric motor section 3 is connected to an inverter 30 that causes an operation frequency to be variable, and is electrically connected via the inverter 30 to a controller section 40 that controls the inverter 30.

The compression mechanism section 2 includes, in a lower portion of the rotation shaft 4, a first cylinder 8A and a second cylinder 8B that are disposed respectively in upper and lower portions via an inbetween partition plate 7. The first and second cylinders 8A and 8B are set to have an external geometric shape dimensions different from each other and bore diameters to be identical to one another.

The first cylinder 8A is formed to have an outside dimension slightly larger than the inner peripheral diameter of the hermetic casing 1, is press fitted into the hermetic casing 1 along the bore surface thereof, and positioned and fastened by welding from the outside of the hermetic casing 1. A primary bearing 9 is superposed on an upper surface portion of the first cylinder 8A and is securely mounted together with a valve cover 100 to the first cylinder 8A by using a mounting bolt 10. A secondary bearing 11 is superposed on a lower surface portion of the second cylinder 8B and is securely mounted together with a valve cover 101 to the first cylinder 8A by using a mounting bolt 12.

The inbetween partition plate 7 and the secondary bearing 11, respectively, have the outside diameters somewhat larger than the internal diameter of the second cylinder 8B. In addition, the bore position of the cylinder 8B is shifted from the cylinder center. As such, a portion of the external periphery of the second cylinder 8B extends longer in the radial direction than the outside diameters of the inbetween partition plate 7 and the secondary bearing 11.

On the other hand, the rotation shaft 4 is pivotably supported such that a midway portion and a lower end portion thereof are rotatably journaled by the primary bearing 9 and the secondary bearing 11, respectively. In addition, the rotation shaft 4 extends through the respective first and second cylinders 8A and 8B, and integrally has two eccentric portions 4*a* and 4*b* formed with a phase difference of substantially 180°. The eccentric portions 4*a* and 4*b* have the diameters identical to one another, and respectively are assembled to be positioned along bore portions of the first and second cylinders 8A and 8B. Eccentric rollers 13*a* and 13*b* having diameters identical to one another are fitted on peripheral surfaces of the eccentric portions 4*a* and 4*b*, respectively.

The first and second cylinders 8A and 8B are partitioned on their upper and lower surfaces by the inbetween partition plate 7, the primary bearing 9, and the secondary bearing 11, thereby forming first and second cylinder chambers 14*a* and 14*b*. The cylinder chambers 14*a* and 14*b* are formed have diameters and height dimensions that are identical to one another, in which the respective eccentric rollers 13*a* and 13*b* are eccentrically rotatably accommodated.

The respective eccentric rollers 13*a* and 13*b* are formed to have the same height dimensions as those of the cylinder chambers 14*a* and 14*b*. As such, while the eccentric rollers 13*a* and 13*b* have the 180° phase difference from one another, they are set to a same excluded volume as being eccentrically rotated in the cylinder chambers 14*a* and 14*b*. Vane chambers 22*a* and 22*b* for communication to the cylinder chambers 14*a* and 14*b* are provided in the cylinders 8A and 8B, respectively. Vanes 15*a* and 15*b*, respectively, are accommodated in the vane chambers 22*a* and 22*b* to be extendable or retractable with respect to the cylinder chambers 14*a* and 14*b*.

Figure 2:
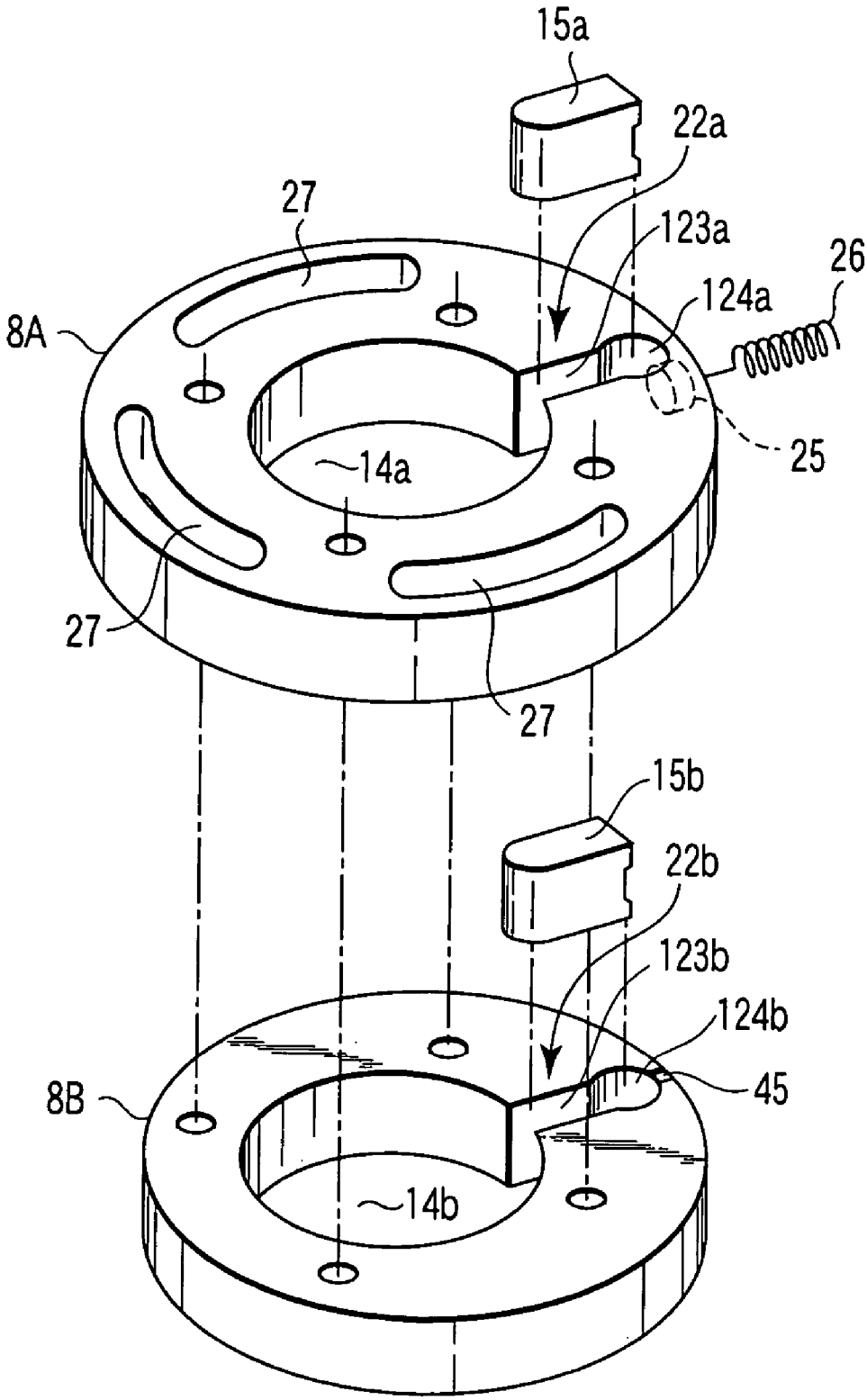
FIG. 2 is an exploded perspective view of a first cylinder and a second cylinder according to the embodiment.

FIG. 2 is an exploded perspective view of the cylinders 8A and 8B.

The vane chamber 22*a*, 22*b*, respectively, is formed of a vane accommodation groove 123*a*, 123*b* along which two (both) side surfaces of the vane 15*a*, 15*b* is slidably movable, and vertical opening portion 124*a*, 124*b* in which a rear end portion of the vane 15*a*, 15*b* integrally provided to the end portion of the accommodation groove 123*a*, 123*b* is accommodated.

A horizontal opening 25 is provided in the first cylinder 8A in the manner of communicating between the external peripheral surface and the vane chamber 22*a*, and a spring member 26 is accommodated in the opening. The spring member 26 is formed of a compression spring that is interposed between the back surface side of the vane 15*a* and the internal peripheral surface of the hermetic casing 1 and that exerts the elastic force (backpressure) to the vane 15*a*, thereby to bring a front end edge into contact with the eccentric roller 13*a*.

While accommodating nothing other than the vane 15*b*, the vane chamber 22*b* on the side of the second cylinder 8B causes, as described further below, the front end edge of the vane 15*b* into contact with the eccentric roller 13*b* in correspondence to a setting environment of the vane chamber 22*b* and operation of a pressure shift mechanism (means) K described below. The front end edge of the respective vane 15*a*, 15*b* is formed semicircular in a plan view, and is linearly contactable with a peripheral wall, which is a circular in a plan view, of the eccentric roller 13*a*, 13*b* regardless of the rotation angle of the eccentric roller 13*a*.

Upon eccentric rotation of the eccentric roller 13*a*, 13*b* along the internal peripheral surface of the cylinder chamber 14*a*, 14*b*, the vane 15*a*, 15*b* is enabled to reciprocatingly operates along the vane accommodation groove 123*a*, 123*b*, and rear end portion of the vane is enabled to extendably or retractably operate with respect to the vertical opening portion 124*a*, 124*b*. As described above, in accordance with the relationship between the external geometric shape of the second cylinder 8B and the external dimensions of the inbetween partition plate 7 and the secondary bearing 11, a portion the external shape of the second cylinder 8B is exposed to the interior of side of the hermetic casing 1.

It is designed such that the portion exposed to the hermetic casing 1 corresponds to the vane chamber 22*b*, so that the vane chamber 22*b* and the rear end portion of the vane 15*b* directly receive the intra-casing pressure. In particular, since the second cylinder 8B and the vane chamber 22*b* are structures, they are not influenced even when received the intra-casing pressure; however, since the vane 15*b* is slidably accommodated in the vane chamber 22*b*, and the rear end portion thereof is positioned in the vertical opening portion 124*b* of the vane chamber 22*b*, the rear end portion directly receives the intra-casing pressure.

Further, the front end portion of the vane 15*b* opposes the second cylinder chamber 14*b*, so that the front end portion of the vane receives the pressure in the cylinder chamber 14*b*. That is, the configuration is formed such that, corresponding to the high/low relationship of pressures received in the front end portion and the rear end portion, the vane 15*b* moves in the direction from the high pressure position to the low pressure position.

A mounting opening or a threaded screw hole for insertion or screwing of the mounting bolts 11 and 12 in the respective cylinder 8A, 8B, and an arcuate gas-running opening portions 27 are provided only in the first cylinder 8A. In the vane chamber 22*b* on the side of the second cylinder 8B, a holder mechanism 45 is provided that urges or compresses the vane 15*b* in the direction of detachment of the vane 15*b* from the eccentric roller 13*b*. In this case, a force is used that is less than a differential pressure between a suction pressure that is introduced into the cylinder chamber 14*b* and a pressure in the hermetic casing 1 that is introduced into the vane chamber 22*b*.

It is sufficient for the holder mechanism 45 to use any one of a permanent magnet, electromagnet, and elastic member. In more specific, the holder mechanism 45 urges and holds the vane 15*b* to be spaced away from the eccentric roller 13*b* by using a force lower than the differential pressure between the suction pressure exerted the second cylinder chamber 14*b* and the pressure in the hermetic casing 1 that is exerted on the vane chamber 22*b*.

A permanent magnet is provided as the holder mechanism 45, thereby to magnetically attract the vane 15*b* normally at a predetermined force. Alternatively, in lieu of the permanent magnet, an electromagnet may be provided to perform magnetic attraction by necessity. Still alternatively, the holder mechanism may be formed of a tension spring or an elastic member. In this case, one end of the draft spring may be retained in a backside end portion of the vane 15*b* to normally perform tensile-urging with a predetermined elastic force.

Referring again to FIG. 1, a discharge pipe 18 is connected to an upper end portion of the hermetic casing 1. The discharge pipe 18 is connected to an accumulator 17 through a condenser 19, an expander mechanism 20, and a vaporizer 21, thereby to configure a refrigeration cycle system. A first and second suction pipes 16*a* and 16*b* for the compressor R are connected to a bottom portion of the accumulator 17. The first suction pipe 16*a* extends through the hermetic casing 1 and communicates to the interior of the first cylinder chamber 14*a*. The second suction pipe 16*b* extends through the hermetic casing 1 and communicates to the interior of the second cylinder chamber 14*b*.

A branch pipe P1 is provided in the following manner. One end thereof of the pipe is connected in a midway portion of the discharge pipe 18 that intercommunicates between the compressor R and the condenser 19. The other end of the pipe is connected in a midway portion of the second suction pipe 16*b* that intercommunicates between the second cylinder chamber 14*b* of the compression mechanism section 2 and the accumulator 17. A first on-off valve 28 is provided in a midway portion of the branch pipe P1. In this case, as shown by a double-dotted chain line in the drawing, no problem takes place even in the state that a one end portion of the branch pipe P1 is extended through the peripheral wall of the hermetic casing 1 to be exposed to the interior thereof. What is essential in this case is that the one end of the branch pipe P1 is present on the high pressure side of the refrigeration cycle.

A second on-off valve 29 is provided on the side upstream of a branch portion of a branch pipe P on the second suction pipe 16*b*. The respective first and second on-off valves 28, 29 each are a solenoid valve that is on-off controlled responsively to an electric signal incoming from the above described controller section 40. Thus, pressure shift mechanism K is configured of the second suction pipe 16*b*, branch pipe P1, first on-off valve 28, and second on-off valve 29 connected to the second cylinder chamber 14*b*. In response to a shift operation of the pressure shift mechanism K, the suction pressure or discharge pressure is introduced into the second cylinder chamber 14*b* provided in the second cylinder 8B.

In the configuration of the accumulator 17, a refrigerant pipe Pa to communicate to the vaporizer 21 is inserted and coupled with an upper end of an accumulator body 17A formed of a hermetic container. In addition, in the accumulator body 17A there are accommodated, in a parallel state, a first suction pipe portion 23*a*, which constitutes the first suction pipe 16*a*, and a second suction pipe portion 23*b*, which constitutes the second suction pipe 16*b*.

An oil returning opening 24*a*, 24*b*, respectively, is provided in a predetermined site of the suction pipe portion 23*a*, 23*b* inside the accumulator body 17A. Thereby, lubricant oil to be mixed into the refrigerant vapor-liquid separated in the accumulator body 17A can be directly guided to return from the suction pipe 16*a*, 16*b* to the cylinder chamber 14*a*, 14*b*.

In particular, in the relative relationship among the oil returning opening 24*b* provided in the second suction pipe portion 23*b*, the second on-off valve 29 provided in the second suction pipe 16*b*, and the connection position of the branch pipe connected to the second suction pipe 16*b*, the second on-off valve 29 is provided on the side upstream of a connection portion D of the branch pipe P1 in the second suction pipe 16*b* and on the side downstream of the oil returning opening 24*b* that opens toward the suction pipe portion 23*b* inside the accumulator 17.

Operation of the refrigeration cycle system including the rotary hermetic compressor R will now be described herebelow.

(1) When normal operation (full capacity operation) has been selected:

The controller section 40 performs control so that the first on-off valve 28, which constitutes the pressure shift mechanism K, is closed, and the second on-off valve 29, which constitutes the same mechanism K, is opened. Then the controller section 40 supplies an operation signal to the electric motor section 3 through the inverter 30. The rotation shaft 4 is rotationally driven, and the eccentric roller 13*a*, 13*b* eccentrically rotates in the respective cylinder chamber 14*a*, 14*b*. In the first cylinder 8A, the vane 15*a* is normally elastically compressed and urged by the spring member 26. Thereby, the front end edge of the vane 15*a* slides on the peripheral wall of the eccentric roller 13*a*, whereby the interior of the first cylinder chamber 14*a* is bisectionally separated into a suction chamber and a compression chamber.

In a state where an internal-peripheral-surface rotary contact position of the eccentric roller 13*a* in the eccentric roller 13*a* matches with the vane accommodation groove 123*a*, and the vane 15*a* is retracted farthest, the space volume of the first cylinder chamber 14*a* is maximized. Refrigerant gas is drawn from the accumulator 17 through the first suction pipe 16*a* into the first cylinder chamber 14*a* to be full therein. With the eccentrically rotation of the eccentric roller 13*a*, the rotary contact position of the eccentric roller moves with respect to the internal peripheral surface of first cylinder chamber 14*a*, whereby the volume of the partitioned compression chamber of the first cylinder chamber 14*a* is decreased. Thus, the gas previously guided into the first cylinder chamber 14*a* is progressively compressed.

The rotation shaft 4 is continually rotated, the volume of the compression chamber of the first cylinder chamber 14*a* is further decreased, and the gas is further compressed. When the pressure is increased to a predetermined pressure level, a discharge valve (not shown) is opened. The high pressure gas is discharged through the valve cover 100 into the hermetic casing 1 to be full therein. Then the gas is discharged from the discharge pipe 18 provided in the upper portion of the hermetic casing.

In addition, the first on-off valve 28 constituting the pressure shift mechanism K is closed, no event occurs in which the discharge pressure (high pressure) is introduced into the second cylinder chamber 14*b*. Since the second on-off valve 29 is kept open, the refrigerant evaporates in the vaporizer 21, and low-pressure evaporated refrigerant vapor-liquid separated in the accumulator 17 is guided into the second cylinder chamber 14*b* through the second suction pipe 16*b*.

Accordingly, the second cylinder chamber 14*b* enters a suction pressure (low pressure) phenomenon, and concurrently, the vane chamber 22*b* is exposed in the hermetic casing 1 to be under the discharge pressure (high pressure). In the vane 15*b*, the front end portion thereof is placed under a low pressure condition, and the rear end portion thereof is placed under a high pressure condition, so that a differential pressure occurs between the front and rear end portions. Influenced by the differential pressure, the front end portion of the vane 15*b* is compressed and urged to slidably contact the eccentric roller 13*b*. More specifically, exactly the same compression operation as in the case where the vane 15*a* on the side of the first cylinder chamber 14*a* is compressed and urged by the spring member 26 is performed in the second cylinder chamber 14*b*.

Thus, in the rotary hermetic compressor R, full capacity operation is performed in which the compression operations are performed with both the first and second cylinder chambers 14*a* and 14*b*. The high pressure gas discharged from the hermetic casing 1 through the discharge pipe 18 is guided into the condenser 19 thereby to be condensed and liquefied, is adiabatically expanded in the expander mechanism 20, and the latent heat of vaporization is removed from heat-exchange air in the vaporizer 21, thereby to effect cooling operation. The refrigerant after evaporation is guided into the accumulator 17, is vapor-liquid separated, is drawn into the compression mechanism section 2 of the compressor R from the first and second suction pipes 16*a*, 16*b*, and is then circulated the channels.

With the holder mechanism 45 provided, the vane 15*b* is urged in the direction of detachment from the eccentric roller 13*b* by using a specified magnetic attraction force or tensile elastic force. However, because the differential pressure between the front and rear end portions of the vane 15*b* is sufficiently greater than the force given by the holder mechanism 45, no event occurs in which the holder mechanism 45 inversely effects the reciprocation of the vane 15*b* during the full capacity operation.

(2) When special operation (halfed-capacity operation) has been selected:

When a special operation (operation with the half compression capacity), the controller section 40 performs shift setting so that the first on-off valve 28 of the pressure shift mechanism K is opened, and the second on-off valve 29 of the mechanism K is closed. As described above, in the first cylinder chamber 14*a*, the normal compression operation is performed, the high pressure gas discharged into the hermetic casing 1 to be full therein, thereby reaching the intra-casing high pressure. Part of the high pressure gas is split for the branch pipe P, and is then directly introduced into the second cylinder chamber 14*b* through the opened first on-off valve 28 and the second suction pipe 16*b*.

While the second cylinder chamber 14*b* enters a discharge-pressure (high pressure) phenomenon, there is no change in that the vane chamber 22*b* is under the same phenomenon as the intra-casing high pressure. As such, the vane 15*b* is influenced by the high pressure at both the front and rear end portions, so that no differential pressure exists between the front and rear end portions. The vane 15*b* does not move, but remains in the stopped state in the position spaced away from the external peripheral surface of the eccentric roller 13*b*, so that the compression operation is not performed in the second cylinder chamber 14*b*. Thus, only the compression operation in the first cylinder chamber 14*a* is valid, so that the capacity-halved operation is effected.

In the capacity-halved operation, the holder mechanism 45 urges the vane 15*b* to be held around the top dead center position at which the front end portion thereof retracts from the peripheral wall of the second cylinder chamber 14*b*. Thus, the vane 15*b* is held in the direction of retraction from the eccentric roller 13*b*.

Also in the capacity-halved operation, there is no change in that the eccentric roller 13*b* is eccentrically rotated in the second cylinder chamber 14*b*, whereby no-load operation is performed. Even when the peripheral wall of the eccentric roller 13*b* reaches the top dead center position of the vane 15*b* opposite to the front end of the vane 15*b*, since the vane 15*b* is held by the holder mechanism 45, the front end portion does not contact the eccentric roller 13*b*.

For example, suppose that the holder mechanism 45 is not provided, and the front end portion of the vane 15*b* is brought into a complete free state. In this case, the front end portion of the vane 15*b* repeats the contact with the eccentric roller 13*b* and moves like dancing in the vane chamber 22*b* during the capacity-halved operation. As such, unless the holder mechanism 45 is provided, a drawback arises in that operational noise is generated due to contact of the vane 15*b* with the eccentric roller 13*b* and the vane 15*b* is damaged. However, with the holder mechanism 45 provided, such problems can be precluded.

In addition, since the interior of the second cylinder chamber 14*b* has the high pressure, there occurs no leakage of the compressed gas from the interior of the hermetic casing 1 to the second cylinder chamber 14*b*, consequently avoiding loss resulting from the leakage. Accordingly, the capacity-halved operation can be accomplished without causing a reduction in compression efficiency.

For example, the operation is now compared to the case in which the rotation speed is regulated to the capacity of the halved excluded volume of the compression mechanism section 2. The results teach that employing the capacity-halved operation enables low capacity operation and hence improvement of compression efficiency in the state of high rotation speed with the same efficiency as that in the normal operation. Consequently, the refrigeration cycle system can be provided that is capable of precisely controlling the temperature and humidity in the manner that the minimum capacity is enlarged by combination with rotation speed regulation. In the compressor R, capacity variability can be implemented, thereby enabling it to obtain cost advantages, high manufacturability, and high efficiency by forming a simple structure only omitting the spring member that urges the vane 15*b*.

In the event of necessity of the maximum capacity, a two-cylinder operation is performed to thereby secure a predetermined capacity, whereby a wide range of capacity can be secured with a single compressor. More specifically, a necessary capacity can easily be obtained by performing on-off control of the first on-off valve 28. In particular, the oil return to the compressor R in the capacity-halved operation is secured, thereby maintaining the lubricant oil of the compression mechanism section 2.

As an example, a case is assumed in which the second on-off valve 29 is provided on the side upstream of the oil returning opening 24*b* provided in the second suction pipe portion 23*b*. In this case, during the capacity-halved operation, the high pressure refrigerant flows in the counter-direction into the accumulator 17 through the oil returning opening 24*b*, thereby causing a significant reduction in the compression capacity in the first cylinder chamber 14*a*. In addition, unless the oil returning opening 24*b* being provided, lubricity is reduced during the normal full capacity operation. As such, setting as described above is indispensable.

In the pressure shift mechanism K, a check valve 29A may be provided in place of the second on-off valve 29 described above. The check valve 29A permits flow of the refrigerant from the accumulator 17 to the side of the second cylinder chamber 14*b*, and prevents flow in the counter-direction.

When the full capacity operation is selected, the first on-off valve 28 is closed, and the low pressure gas guided by the second suction pipe 16*b* is introduced into the second cylinder chamber 14*b* through the check valve 29A. The second cylinder chamber 14*b* reaches the state of the suction pressure (low pressure), and concurrently, the vane chamber 22*b* reaches the state of the intra-casing high pressure, so that a differential pressure occurs between the front and rear end portions of the vane 15*b*. The vane 15*b* normally receives backpressure to extend to the second cylinder chamber 14*b*, and is brought into contact with the eccentric roller 13*b*, whereby the compression operation is performed. Of course, the compression operation is performed also in the first cylinder chamber 14*a*, so that the full capacity operation is effected.

When the capacity-halved operation is selected, the first on-off valve 28 is opened. Part of the high pressure gas being introduced from the discharge pipe 18 into the branch pipe P1 is guided to the second suction pipe 16*b* through the first on-off valve 28. Then, the flow to the accumulator 17 is shut off by the check valve 29A, so that all flows are introduced to the second cylinder chamber 14*b*. Thus, while the second cylinder chamber 14*b* becomes the state of high pressure, the vane chamber 22*b* stays at low pressure, no differential pressure occurs between the front and rear end portions of the vane 15*b*. The position of the vane 15*b* remains unchanged, so that the compression operation is not effected in the second cylinder chamber 14*b*. Consequently, the capacity-halved operation is effected only with the first cylinder chamber 14*a*.

As one feature, in the configuration having the check valve 29A (or the second on-off valve 29 (this way of expression applies herebelow) provided in the second suction pipe 16*b*, the check valve 29A is positioned at a predetermined spacing (at least 10 mm or greater) from a welded portion E of the accumulator 17 and the second suction pipe 16*b*. More specifically, since a valve element body of the check valve 29A is formed of a thin plate, the valve element is likely to have thermal effects. However, since the valve is provided in the positioned at the predetermined spacing, the provision avoids as far as possible the thermal effects on the valve in event of welding the accumulator 17 and the second suction pipe 16*b*.

Figure 3:
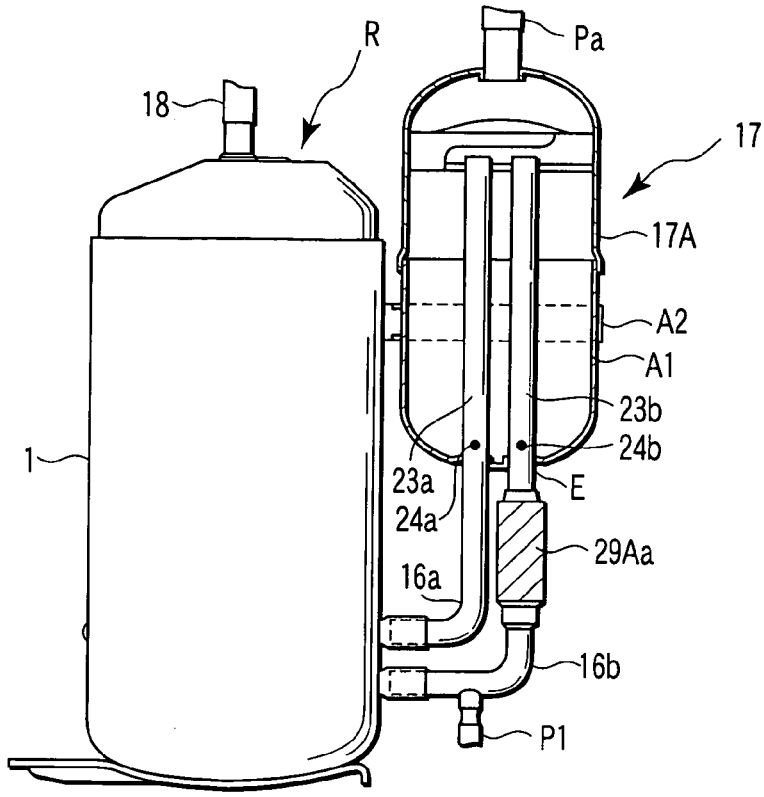
FIG. 3 is a view descriptive of a connection structure of a rotary hermetic compressor and an accumulator according to a second embodiment of the present invention.

FIG. 3 shows a connection structure of a rotary hermetic compressor R and an inbetween partition plate 7 according to a second embodiment.

The accumulator 17 is configured such that the first and second suction pipes 16*a* and 16*b* are integrally extended to a portion directly under the accumulator body 17A from the suction pipe portions 23*a* and 23*b* accommodated in the accumulator body 17A. A check valve 29Aa provided in the second suction pipe 16*b* is positioned in the portion directly under the accumulator body 17A.

More specifically, in addition to the effects of the configuration shown in FIG. 1, the accumulator 17, the suction pipe portions 23*a* and 23*b*, and the check valve 29Aa are configured into a substantially integral structure, thereby making it possible to secure high capacity and high reliability. To avoid thermal effects of the welded portion E of the accumulator 17 and the second suction pipe 16*b*, the check valve 29Aa is spaced away at least 10 mm or greater.

In addition, although the mounting position of the accumulator 17 is high, a lower cup A1 constituting the accumulator body 17A fixedly mounted to the hermetic casing 1 of the compressor R by using an accumulating band A2, thereby making it possible to implement space saving.

Figure 4:
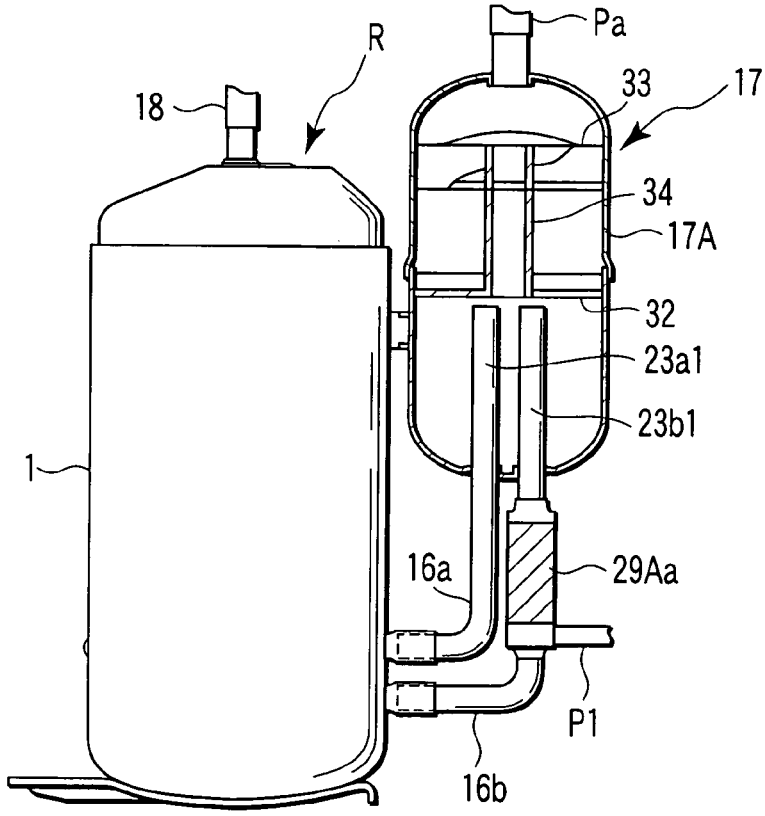
FIG. 4 is a view descriptive of a connection structure of a rotary hermetic compressor and an accumulator according to a third embodiment of the present invention.

FIG. 4 is a view descriptive of a connection structure of a rotary hermetic compressor R and an accumulator 17A according to a third embodiment.

Under a prerequisite condition in which a check valve 29Aa is mounted in a portion directly under the accumulator body 17A, the interior of the accumulator body 17A is separated upper and lower portions through an upper-lower separation plate 32, in which the capacity is secured in an upper portion of the upper-lower separation plate 32. In addition, a communication pipe 34 is provided between a retainer 33 provided in an upper portion and the upper-lower separation plate 32, in which the capacity is secured also in a lower portion of the upper-lower separation plate 32.

In addition to the effects of the configuration shown in FIG. 3, the lengths of first and second suction pipe portions 23*a*1 and 23*b*1 can be made identical to the ordinary (conventional) lengths. This enables preventing performance degradation attributed to a reduction in supercharge effects. Further, innate vapor-liquid separation performance can be obtained, and high reliability is secured.

Figure 5:
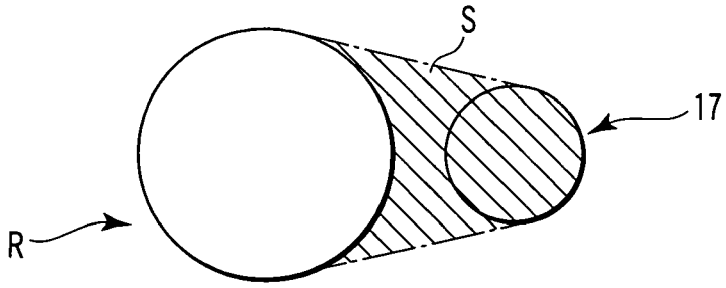
FIG. 5 is a view descriptive of a connection structure of a rotary hermetic compressor and an accumulator according to a fourth embodiment of the present invention.

FIG. 5 is a schematic plan view showing a rotary hermetic compressor R and an accumulator 17 according to a fourth embodiment. In the configuration shown in FIGS. 3, 4, although the check valve 29Aa, 29Ab in the second suction pipe 16*b* is provided in the portion directly under the accumulator 17, it is not limited thereto. As one feature, the check valve 29Aa, 29Ab is provided between the hermetic casing 1 and the accumulator 17 and within a projected area S shown by hatched lines that is formed with a tangential line between the external peripheral surface of the hermetic casing 1 and the external peripheral surface of the accumulator 17. As such, a case can take place in which the accumulator 17 and the check valve 29Aa, 29Ab are parallelly arranged, whereby possible increase in horizontal spacing due to the provision of the check valve can be prevented.

Figure 6:
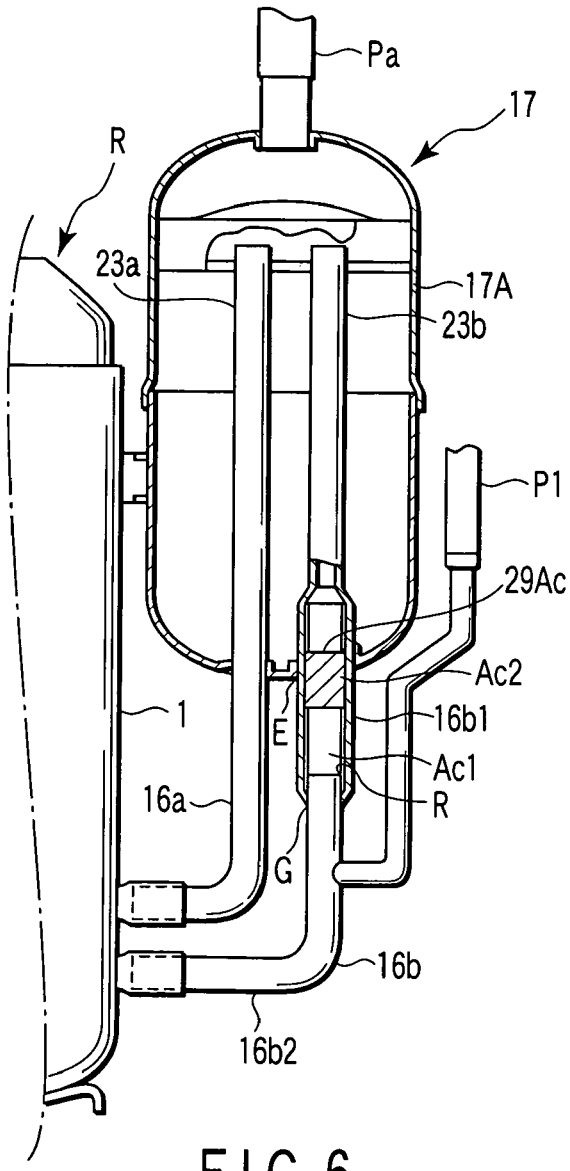
FIG. 6 is a view descriptive of a connection structure of a rotary hermetic compressor and an accumulator according to a fifth embodiment of the present invention.

FIG. 6 is a schematic cross sectional view showing a part of a rotary hermetic compressor R and an accumulator 17 according to a fifth embodiment.

The second suction pipe 16*b* communicating to the second cylinder chamber 14*b* is bisectionally separated in a midway portion. A separated suction pipe 16*b*1 on the one side is fixedly secured to the accumulator 17, and a separated suction pipe 16*b*2 is fixedly secured to the hermetic casing 1. More specifically, the separated suction pipe 16*b*1 fixedly secured to the accumulator 17 is formed of a pipe identical to the second suction pipe portion 23*b* in the accumulator body 17A. A lower end portion extending from the accumulator body 17A with the separated suction pipe 16*b*1 is expanded in the diameter and is fitted in an overlapping manner on an upper end portion of the separated suction pipe 16*b*2 fixedly secured to the hermetic casing 1.

As a work sequence, the accumulator body 17A is turned upside down, and the first suction pipe 16*a* and the separated suction pipe 16*b*1 (pipe identical to the second suction pipe portion 23*b*) on the one side are welded together. In this event, since a check valve 29Ac is not set, no case occurs in which the check valve 29Ac receives thermal effects of welding of the accumulator 17 and the separated suction pipe 16*b*1 in the welded portion E.

Subsequently, the check valve 29Ac is inserted from an open end of the separated suction pipe 16*b*1. In this event, an check-valve valving portion Ac2 formed of a valve element and valve seat portion shown by hatched lines is first inserted, and a check valve body Ac1 is positioned on the side of the open end. Then, the separated suction pipe 16*b*2 on the other side is inserted on the open end of the separated suction pipe 16*b*1, and they are welded to one another into an integral unit (site G). The check valve body Ac1 has a shape as a pipe, but no problem occurs for welding to the separated suction pipe 16*b*1.

In this state, the first suction pipe 16*a* and the second suction pipe 16*b* (actually, the separated suction pipe 16*b*2) are extending from the accumulator body 17A, in which end portions of the suction pipes are welded to the hermetic casing 1.

Thus, the suction pipe 16*b* communicating to the accumulator 17 is separated, and the check valve body Ac1 is disposed by being inserted into the separated suction pipe 16*b*1. Thereby, space saving can be implemented, the mounting height of the accumulator 17 is lowered, the length of the suction pipe 16*b* can be reduced, and performance enhancement can be attained. For the position of the check-valve valving portion Ac2 of the check valve 29Ac, a distance can be secured to receive less thermal effects during welding, therefore enabling reliability to be obtained. The check-valve valving portion Ac2 constituting the check valve 29Ac has a double wall structure, therefore exhibiting operational noise reduction effects. The oil returning opening 24*b* and a check-valve positioning notch or taper portion may be provided for the second suction pipe 16*b*, and a positioning portion h (such as a protrusion) may be provided in the check valve body Ac1.

With the check valve 29A provided in the portion directly under the accumulator 17, since the check valve 29A has to be spaced away at the predetermined distance to avoid the thermal effects of the welded portion E of the accumulator 17 and the second suction pipe 16*b*, the position of the accumulator 17 is correspondingly high. On the other hand, in the case that the length of the suction pipe portion 23*a*, 23*b* in the accumulator 17 is made identical to the length in the conventional case in order to effectively use the volume of the accumulator 17, the total length of the suction pipe 16*a*, 16*b* is increased, so that suction resistance is increased and hence compression performance is reduced. As such, the height of the accumulator 17 can be somewhat reduced by employing the configuration of FIG. 6, thereby contributing to solving the problems described above.

Figure 7:
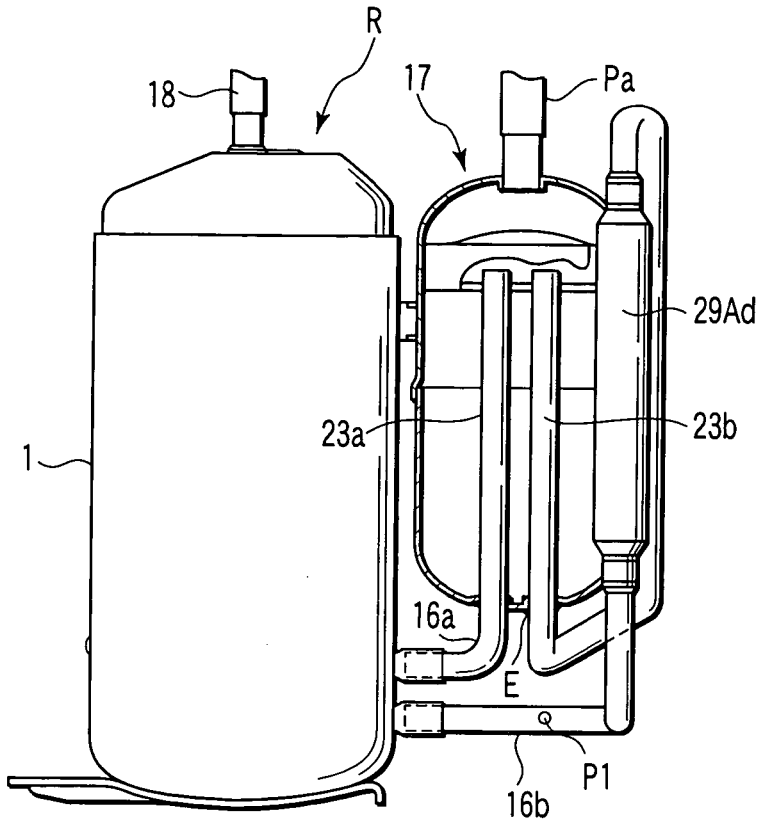
FIG. 7 is a view descriptive of a connection structure of a rotary hermetic compressor and an accumulator according to a sixth embodiment of the present invention.

FIG. 7 is a view descriptive of a connection structure of a rotary hermetic compressor R and an accumulator 17 according to a sixth embodiment.

The configuration is formed such that the second suction pipe 16*b* communicating to the second cylinder chamber 14*b* is vertically provided to the side portion of accumulator 17, and a check valve 29Ad is provided in the vertical portion. Consequently, the accumulator 17 and the check valve 29Ad are parallelly arranged, whereby the height of the accumulator 17 can be reduced similarly as in the conventional case, so that the arrangement is useful to implement space saving. The position of the check valve 29Ad is spaced away at a sufficient distance from the welded portion E of the accumulator 17 and the second suction pipe 16*b*, so that thermal effects can be avoided and high reliability can be secured.

Figure 8:
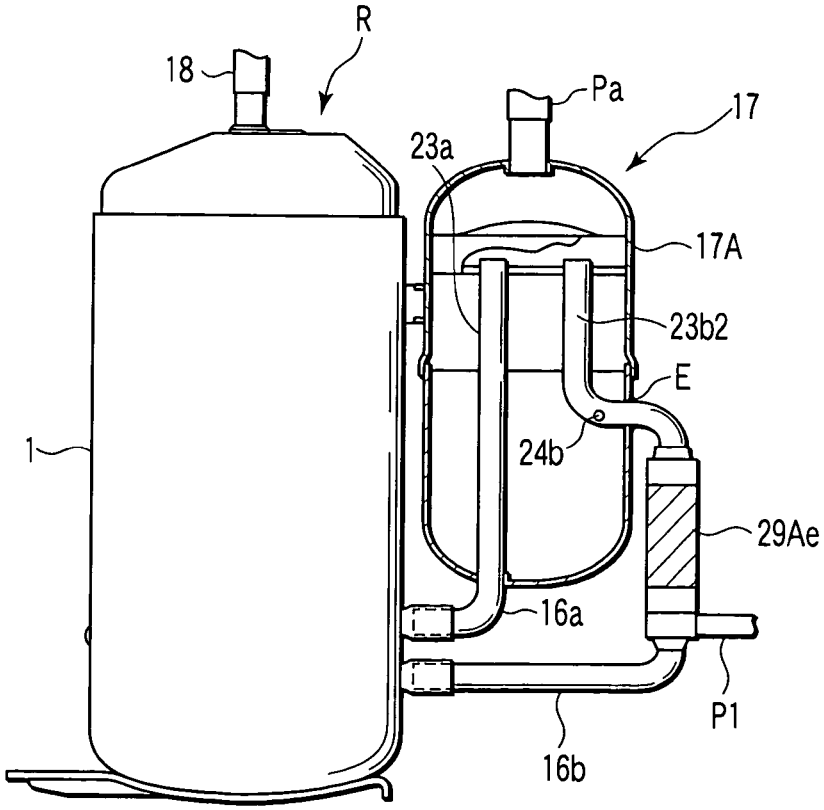
FIG. 8 is a view descriptive of a connection structure of a rotary hermetic compressor and an accumulator according to a seventh embodiment of the present invention.

FIG. 8 is a view descriptive of a connection structure of a rotary hermetic compressor R and an accumulator 17 according to a seventh embodiment.

Similarly as in the sixth embodiment, the accumulator 17 and a check valve 29Af are parallelly arranged. In this case, however, a second suction pipe portion 23*b*2 in the accumulator body 17A is horizontally bent at a substantially center portion and is externally extended from the peripheral wall of the accumulator body 17A to form the second suction pipe 16*b*. The oil returning opening 24*b* is provided in an immediately-before site externally extending from the peripheral wall of the accumulator body 17A.

As in the conventional case, because the height of the accumulator 17 can be reduced, the arrangement is useful to implement space saving. The position of the check valve 29Ae is spaced away at a sufficient distance from the welded portion E of the accumulator 17 and the second suction pipe 16*b*, so that thermal effects can be avoided and high reliability can be secured.

Figure 9:
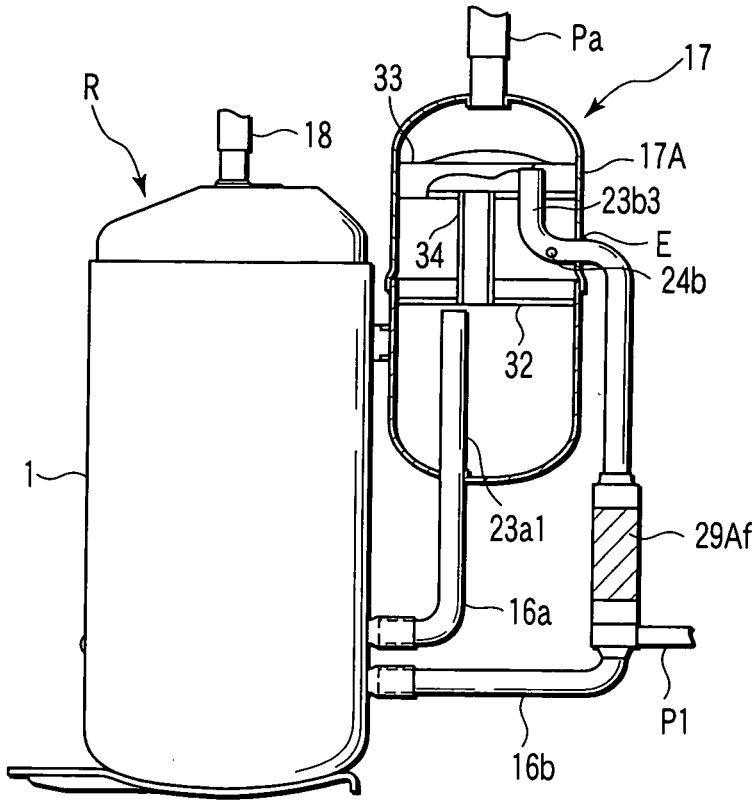
FIG. 9 is a view descriptive of a connection structure of a rotary hermetic compressor and an accumulator according to an eighth embodiment of the present invention.

FIG. 9 is a view descriptive of a connection structure of a rotary hermetic compressor R and an accumulator 17 according to an eighth embodiment.

Similarly as in the seventh embodiment, the accumulator 17 and a check valve 29Ae are parallelly arranged, and a second suction pipe portion 23*b*3 in the accumulator body 17A is horizontally bent at a substantially center portion and is externally extended from the peripheral wall of the accumulator body 17A to form the second suction pipe 16*b*. In the accumulator 17, an upper-lower separation plate 32 is provided in a substantially upper-lower center portion of the accumulator body 17A, and a communication pipe 34 is interposed between the upper-lower separation plate 32 and a retainer 33.

A second suction pipe portion 23*b*3 has an upper end portion opened in the same position as the retainer 33, and has a lower end portion that is bent between the retainer 33 and the upper-lower separation plate 32 and that externally extends from a peripheral wall of the suction pipe portion 23*b*3. The oil returning opening 24*b* is provided in the bent portion, and an upper end opening of a first suction pipe portion 23*a*1 is positioned on the lower side of the upper-lower separation plate 32.

In this case also, because the height of the accumulator 17 can be reduced, the arrangement is useful to implement space saving. The position of a check valve 29Af is spaced away at a sufficient distance from the welded portion E of the accumulator 17 and the second suction pipe 16*b*, so that thermal effects can be avoided and high reliability can be secured.

Figure 10:
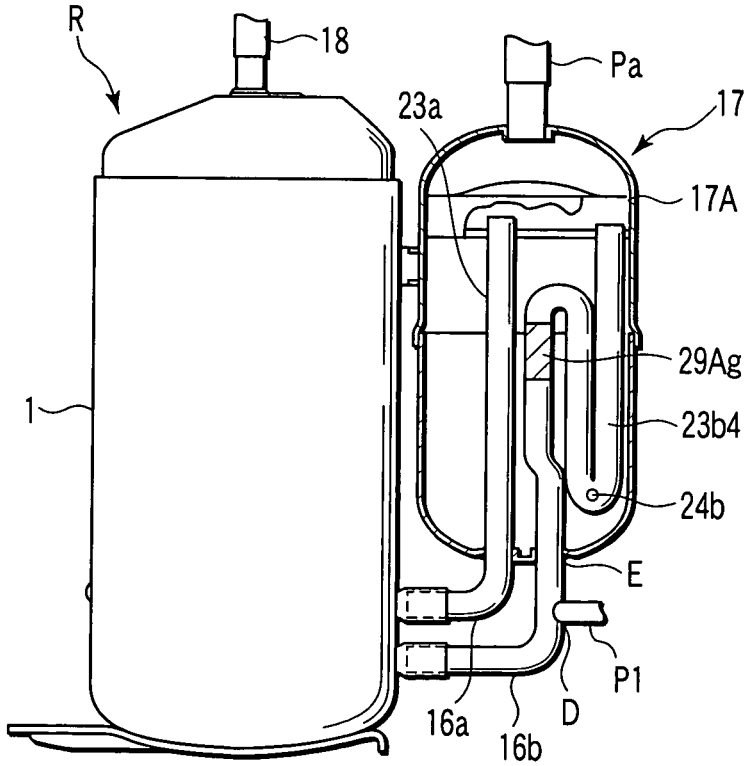
FIG. 10 is a view descriptive of a connection structure of a rotary hermetic compressor and an accumulator according to a ninth embodiment of the present invention.

FIG. 10 is a view descriptive of a connection structure of a rotary hermetic compressor R and an accumulator 17 according to a ninth embodiment.

There is no change in that the second suction pipe 16*b* communicating to the second cylinder chamber 14*b* is integrated with a second suction pipe portion 23*b*4 in the accumulator body 17A. However, the second suction pipe portion 23*b*4 is bent in a substantially U shape with its upper and lower portions and is formed overall in a meander shape. The oil returning opening 24*b* is provided in the U-bent portion and is of course positioned on the side upstream of the connection portion D of the branch pipe P1 that connects to the second suction pipe 16*b*.

In the configuration, similarly as in the conventional case, since the accumulator 17 can be provided in a lower position by reducing the height thereof, space saving, can be attained. A check valve 29Ag is mounted inside the accumulator body 17A, such that operational noise does not leak to the outside from the accumulator 17, consequently enabling noise reduction. The position of a check valve 29Ag is spaced away at a sufficient distance from the welded portion E of the accumulator 17 and the second suction pipe 16*b*, so that thermal effects can be avoided and high reliability can be secured.

Figure 11:
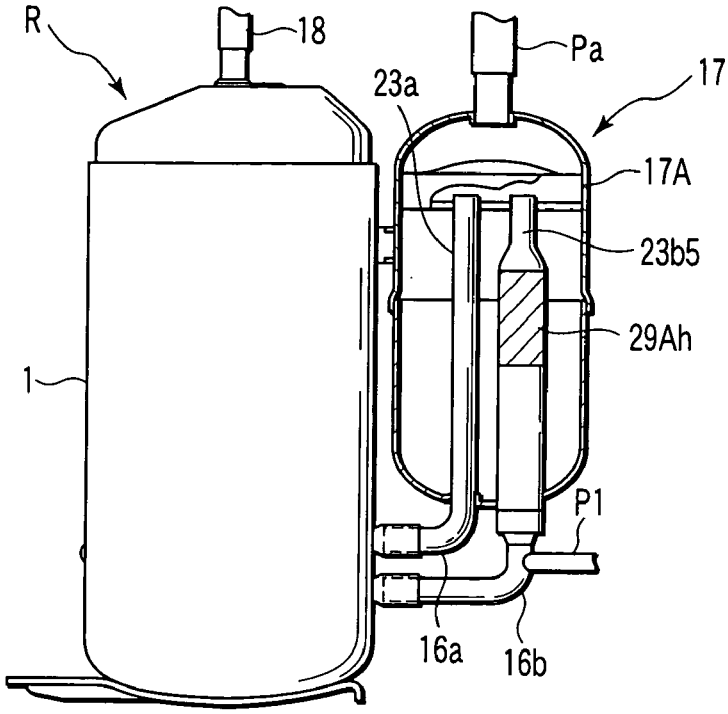
FIG. 11 is a view descriptive of a connection structure of a rotary hermetic compressor and an accumulator according to a 10th embodiment of the present invention.

FIG. 11 is a view descriptive of a connection structure of a rotary hermetic compressor R and an accumulator 17 according to a 10th embodiment.

There is no change in that the second suction pipe 16*b* communicating to the second cylinder chamber 14*b* is integrated with a second suction pipe portion 23*b*5 in the accumulator body 17A. However, most portions of the second suction pipe portion 23*b*5 form a check valve 29Ah, and the check valve 29Ah is substantially accommodated state in the accumulator 17. However, the oil returning opening is not provided.

Accordingly, the accumulator 17 can be provided in a lower position by reducing the height thereof, and hence space saving, can be attained. The check valve 29Ah is mounted inside the accumulator body 17A, such that operational noise does not leak to the outside from the accumulator 17, consequently enabling noise reduction.

Figure 12:
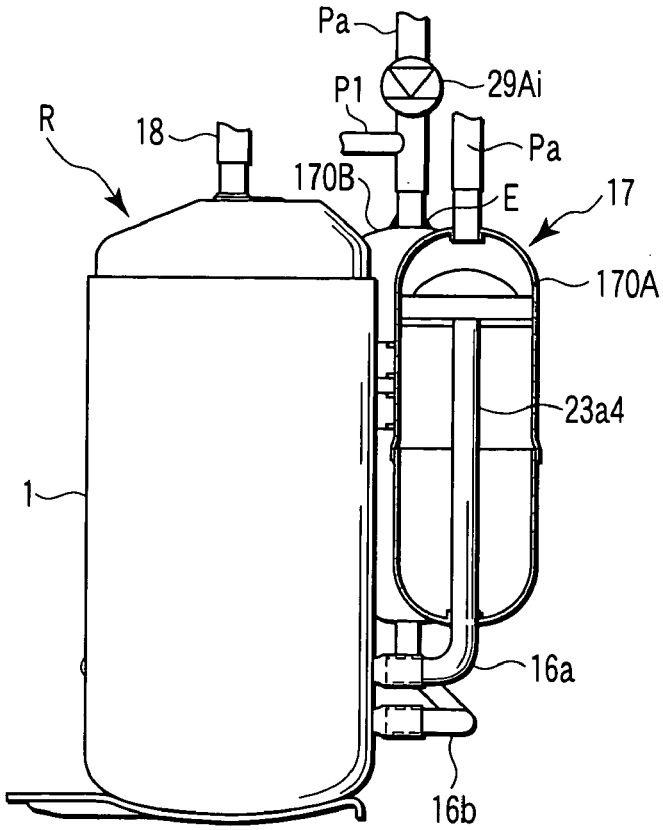
FIG. 12 is a view descriptive of a connection structure of a rotary hermetic compressor and an accumulator according to an 11th embodiment of the present invention.

FIG. 12 is a view descriptive of a connection structure of a rotary hermetic compressor R and an accumulator 17 according to an 11th embodiment.

A first accumulator 170A is connected to the first suction pipe 16*a* communicating to the first cylinder chamber 14*a*, and a second accumulator 170B is connected to the second suction pipe 16*b* communicating to the second cylinder chamber 14*b*. Thus, the first and second accumulators 170A and 17B each having an independent configuration are connected to the first and second suction pipes 16*a* and 16*b*, respectively. As a matter of course, in the respective accumulators 170A and 170B, suction pipe portions 23*a*4 and 23*b*4 (23*b*4 is not shown) integral with the respective suction pipes 16*a* and 16*b* suction pipes 16*a* and 16*b* are provided.

In particular, the other end of the branch pipe P1 connected to the high pressure gas of the refrigeration cycle is connected to the refrigerant pipe Pa on the side upstream of the second accumulator 170B. A check valve 29Ai is provided on an upstream side from the connection portion of the branch pipe P1 in the refrigerant pipe Pa.

In such a configuration, the suction pressure or discharge pressure can be guided into the second cylinder chamber 14*b* through the branch pipe P1 and the second accumulator 17B. In addition, the position of a check valve 29Ai is spaced away at a sufficient distance from the welded portion E of the refrigerant pipe Pa and the second accumulator 170B, so that manufacturing reliability can be secured. Before the check valve 29Ai is mounted, delivery inspection can be performed to verify whether least one of compression functions is available, so that high reliability can be secured.

Further, similarly as the cases described above, no problems occur even in the configuration in which the branch pipe P1 and the check valve 29Ai are provided in the second suction pipe 16*b* communication between the second accumulator 170B and the second cylinder chamber 14*b*.

The respective one of all the above-described rotary hermetic compressors R and accumulators 17 compressor R can be used for the refrigeration cycle shown in FIG. 1 and even for a heat-pump type refrigeration cycle, thereby making it possible to attain capacity enhancement and efficiency enhancement during cooling operation and heating operation.

According to the present invention, in a prerequisite condition in which first and second cylinders are provided, a rotary hermetic compressor in which a compression urging structure for a vane of one of the cylinders is omitted and the number of components is reduced to thereby enable reliability improvement can be provided, and a refrigeration cycle system using the rotary hermetic compressor can be provided.

What is claimed is:

1. A rotary hermetic compressor for use in a refrigeration cycle, in which an electric motor section and a rotary compression mechanism section to be coupled to the electric motor section are accommodated, a refrigerant evaporated in a vaporizer is drawn into the compression mechanism section through an accumulator, and a refrigerant gas compressed therein is once discharged into a hermetic casing, thereby to create an intra-casing high pressure, wherein the compression mechanism section comprises: a first cylinder and a second cylinder which each includes a cylinder chamber wherein an eccentric roller is eccentrically rotatably accommodated; and vanes which are respectively provided in the first cylinder and the second cylinder wherein front end portions thereof are each compressed and urged to contact a peripheral surface of the eccentric roller to thereby bisectionally separate the cylinder chamber along a rotation direction of the eccentric roller, and vane chambers which accommodate rear side end portions of the respective vanes, the vane provided in the first cylinder is compressed and urged by a spring member disposed in the vane chamber, the vane provided in the second cylinder is compressed and urged corresponding to a differential pressure between the intra-casing pressure guided into the vane chamber and a suction pressure or discharge pressure guided to the cylinder chamber, and a guide guiding the suction pressure or discharge pressure into the cylinder chamber of the second cylinder comprises:

a branch pipe having a one end connected to a high pressure side of the refrigeration cycle, an other end connected to a suction pipe communicating from the accumulator to the cylinder chamber of the second cylinder, and a first on-off valve in a midway portion; and a second on-off valve or a check valve which is provided in the suction pipe on a side upstream of a connection portion with the branch pipe and on a side downstream of an oil returning opening opened to a suction pipe section in the accumulator.

2. A rotary hermetic compressor according to claim 1, wherein the second on-off valve or the check valve which constitutes the guide guiding the suction pressure or discharge pressure into the cylinder chamber of the second cylinder is provided to have a predetermined distance from a juncture portion with the suction pipe for the accumulator.

3. A rotary hermetic compressor according to claim 1, wherein the second on-off valve or the check valve which constitutes the guide guiding the suction pressure or discharge pressure into the cylinder chamber of the second cylinder is provided between the hermetic casing and the accumulator and within a projected area formed with tangential lines of an external peripheral surface of the hermetic casing and an external peripheral surface of the accumulator.

4. A rotary hermetic compressor according to claim 1, wherein the suction pipe communicating to the cylinder chamber of the second cylinder is bisectionally separated in a midway portion, a separated suction pipe on one side is fixedly secured to the accumulator, a separated suction pipe on the other side is fixedly secured to the hermetic casing, and the second on-off valve or the check valve is inserted and fitted in a coupling section of the respective separated suction pipes.

5. A rotary hermetic compressor according to claim 1, wherein the accumulator and the second on-off valve or the check valve are arranged adjacent to one another.

6. A refrigeration cycle system, comprising a refrigeration cycle formed of, a condenser, an expander mechanism, a vaporizer, and the rotary hermetic compressor according to claim 1.

7. A rotary hermetic compressor for use in a refrigeration cycle, in which an electric motor section and a rotary compression mechanism section to be coupled to the electric motor section are accommodated, a refrigerant evaporated in a vaporizer is drawn into the compression mechanism section through an accumulator, and a refrigerant gas compressed therein is once discharged into a hermetic casing, thereby to create an intra-casing high pressure, wherein the compression mechanism section comprises: a first cylinder and a second cylinder which each includes a cylinder chamber wherein an eccentric roller is eccentrically rotatably accommodated; and vanes which are respectively provided in the first cylinder and the second cylinder wherein front end portions thereof are each compressed and urged to contact a peripheral surface of the eccentric roller to thereby bisectionally separate the cylinder chamber along a rotation direction of the eccentric roller, and vane chambers which accommodate rear side end portions of the respective vanes, the vane provided in the first cylinder is compressed and urged by a spring member disposed in the vane chamber, the vane provided in the second cylinder is compressed and urged corresponding to a differential pressure between the intra-casing pressure guided into the vane chamber and a suction pressure or discharge pressure guided to the cylinder chamber, and means for guiding the suction pressure or discharge pressure into the cylinder chamber of the second cylinder comprises:

a branch pipe having a one end connected to a high pressure side of the refrigeration cycle, an other end connected to a suction pipe communicating from the accumulator to the cylinder chamber of the second cylinder, and a first on-off valve in a midway portion; and a second on-off valve or a check valve which is provided in the suction pipe on a side upstream of a connection portion of the branch pipe and in a suction pipe section inside the accumulator.

8. A refrigeration cycle system, comprising a refrigeration cycle formed of a condenser, an expander mechanism, a vaporizer, and the rotary hermetic compressor according to claim 7.

9. A rotary hermetic compressor for use in a refrigeration cycle, in which an electric motor section and a rotary compression mechanism section to be coupled to the electric motor section are accommodated, a refrigerant evaporated in a vaporizer is drawn into the compression mechanism section through an accumulator, and a refrigerant gas compressed therein is once discharged into a hermetic casing, thereby to create an intra-casing high pressure, wherein the compression mechanism section comprises: a first cylinder and a second cylinder which each includes a cylinder chamber wherein an eccentric roller is eccentrically rotatably accommodated; and vanes which are respectively provided in the first cylinder and the second cylinder wherein front end portions thereof are each compressed and urged to contact a peripheral surface of the eccentric roller to thereby bisectionally separate the cylinder chamber along a rotation direction of the eccentric roller, and vane chambers which accommodate rear side end portions of the respective vanes, the vane provided in the first cylinder is compressed and urged by a spring member disposed in the vane chamber, the vane provided in the second cylinder is compressed and urged corresponding to a differential pressure between an intra-casing pressure guided into the vane chamber and a suction pressure or discharge pressure guided to the cylinder chamber, and means for guiding the suction pressure or discharge pressure into the cylinder chamber of the second cylinder comprises:

a branch pipe having a one end connected to a high pressure side of the refrigeration cycle and another end connected to a refrigerant pipe on a side upstream of a second accumulator; and an on-off valve or a check valve provided in the suction pipe on a side upstream of a connection portion of the branch pipe and in a suction pipe section inside the accumulator.

10. A refrigeration cycle system, comprising a refrigeration cycle formed of a condenser, an expander mechanism, a vaporizer, and the rotary hermetic compressor according to claim 9.

* * * * *